US007699288B2

(12) United States Patent
Kimbrew

(10) Patent No.: US 7,699,288 B2
(45) Date of Patent: Apr. 20, 2010

(54) DELINEATOR EXTRACTION SYSTEM

(75) Inventor: Kade Allen Kimbrew, Electra, TX (US)

(73) Assignee: Texas Department of Transportation, Austin, TX (US)

( * ) Notice: Subject to any disclaimer, the term of this patent is extended or adjusted under 35 U.S.C. 154(b) by 81 days.

(21) Appl. No.: 12/055,122

(22) Filed: Mar. 25, 2008

(65) Prior Publication Data

US 2009/0206227 A1 Aug. 20, 2009

Related U.S. Application Data

(60) Provisional application No. 61/028,810, filed on Feb. 14, 2008.

(51) Int. Cl.
*F16M 13/00* (2006.01)

(52) U.S. Cl. ..... 248/544

(58) Field of Classification Search ..... 248/544, 248/545, 546, 85, 87, 156, 530
See application file for complete search history.

(56) References Cited

U.S. PATENT DOCUMENTS

| | | | | | |
|---|---|---|---|---|---|
| 139,169 | A | * | 5/1873 | Lindsley | 294/50.8 |
| 752,115 | A | * | 2/1904 | Smith | 294/50.8 |
| 1,647,832 | A | * | 11/1927 | Kovar | 294/50.5 |
| 3,506,296 | A | * | 4/1970 | Nelson | 111/101 |
| 4,092,081 | A | | 5/1978 | Schmanski | |
| RE32,045 | E | | 12/1985 | Schmanski | |
| 4,765,277 | A | * | 8/1988 | Bailey et al. | 119/57.9 |
| 4,836,231 | A | * | 6/1989 | Peterson | 135/98 |
| 4,910,902 | A | * | 3/1990 | Anderson | 40/607.06 |
| 5,337,841 | A | * | 8/1994 | Mukai | 175/293 |
| 6,149,340 | A | | 11/2000 | Pateman | |
| 7,003,919 | B2 | | 2/2006 | Riker | |
| 2007/0053744 | A1 | | 3/2007 | Mudryk et al. | |

OTHER PUBLICATIONS

A01—Web site referring to a product provided by Eberl Iron Works Inc. called U-jack™.
A02—Web site referring to a product provided by Carsonite called the Carsonite Post Puller.
A03—Web site referring to a product provided by Shur-Tite® called the "Wedge Puller" and the "Wedge Driver".

* cited by examiner

*Primary Examiner*—J. Allen Shriver, II
*Assistant Examiner*—Erin Smith
(74) *Attorney, Agent, or Firm*—Meyertons, Hood, Kivlin, Kowert & Goetzel, P.C.; Eric B. Meyertons

(57) ABSTRACT

A system and method for extracting broken delineators severed adjacent to a ground surface where the delineator was installed. A distal end of a delineator extractor may be positionable in a delineator conduit. At least a portion of the distal end of the delineator extractor may be configured to engage an interior surface of the delineator conduit when the delineator extractor is activated. Upon the delineator extractor engaging the delineator conduit, a user may activate a slide hammer of the delineator extractor to amplify a force applied by the user to assist in extracting the delineator conduit. A delineator extraction system may include an installer couplable to a distal end of an outer conduit of a delineator extractor. The installer may function to install or extract a delineator system.

13 Claims, 4 Drawing Sheets

DELINEATOR EXTRACTION SYSTEM

PRIORITY CLAIM

This application claims priority to U.S. Provisional Patent Application No. 61/028,810 entitled "DELINEATOR EXTRACTION SYSTEM" filed on Feb. 14, 2008, which is incorporated by reference herein.

BACKGROUND OF THE INVENTION

1. Field of the Invention

The present disclosure generally relates to a delineator extraction and/or installation system. More particularly, the disclosure generally relates to systems and methods for extracting a broken delineator severed adjacent to the surface.

2. Description of the Relevant Art

Examples of roadside posts include sign posts and guide posts and typically all of these fall into a class referred to more commonly as delineators. Delineators are typically placed along or on a road or highway and used to guide traffic. Due to their placement adjacent highways delineators are often impacted and damaged by vehicles including road maintenance machinery. Repairing and/or replacing damaged delineators can be an expensive and financially draining endeavor for local and federal governments.

Conventional sign post mounts are a tubular device that is fixed in concrete or driven into the ground to receive the sign post and mount the sign post in an upright position. A driven-in fastener is often used to attach the sign post to the in-ground post mount to secure the sign post in the upright position. Many known post mount systems, however, are prone to loosening, tilting and/or rotation due to wind loading, temperature changes or impact on the sign post. Another known problem with existing post mounts is the hazard that arises from use of sharp and abruptly-edged metal components.

In response to these problems many different types of delineator systems have been developed to combat the problems. U.S. Pat. No. 7,003,919, which is incorporated by reference as if fully set forth herein, describes a delineator system including a post and post mount assembly in a hole in the ground, wherein there is a socket in the hole. Concrete is positioned in the annular space between the interior walls of the hole and the exterior of the socket. A post is positioned in the socket and a wedge member having a tapered portion fills a gap between the socket and the post. Specifically the described system employs a flexible wedge to stabilize a post positioned in a tube which is typically positioned in reinforced concrete below a ground surface. Other systems may use a post which includes a flexible joint near the post's insertion point into the ground. Problems have arisen when some of these new delineator systems are over run by a vehicle or mower resulting in the post and/or wedge being severed adjacent to the surface of the ground. When this occurs it is difficult to remove what is left of the delineator system still positioned in the ground.

SUMMARY

The present invention solves the problems described above by providing novel system which functions to extract broken or severed delineators from the ground.

In some embodiments, a delineator extraction system may function to extract and/or install a damaged and/or undamaged delineator. A delineator extraction system may include an outer conduit, a first elongated member, a slide hammer, a second elongated member, and an extractor.

An outer conduit may include a first distally positioned portion and a second proximally positioned portion. The first and second portion may be separated by a first stop. The first portion may include a second stop positioned at a distal end of the outer conduit. The outer conduit may be positionable in a delineator conduit.

A first elongated member may include a proximal end coupled to the distal end of the outer conduit. A distal end of the first elongated member may be threaded.

A slide hammer may be positioned in the first portion of the outer conduit. The slide hammer may be moveable in the first portion of the outer conduit between the first and second stops. The slide hammer may function to amplify a force applied by a user.

A second elongated member may extend through a first opening in the first stop. The distal end of the second elongated member may be coupled to the slide hammer. A proximal end of the second elongated member may extend through a second opening in a proximal end of the outer conduit.

An extractor may be couplable to the threaded distal end of the first elongated member. The extractor may include a third opening and at least one engager. The third opening may be threaded such that the opening is couplable to the distal end of the first elongated member. The extractor may be positionable along the threaded portion of the first elongated member. At least one engager may include a distal end coupled to the extractor. The distal end of the engager may be coupled to the extractor such that the proximal end of at least one of the engagers is configured to rotate away from the outer conduit. The engager may rotate away from the outer conduit as the distal end of the outer conduit moves toward the extractor such that the proximal end of the engager engages an interior surface of the delineator conduit.

In some embodiments, a delineator extraction system may include surface deformations positioned at a distal end of the extractor. The surface deformations may function to engage a surface. The surface deformations may function to inhibit rotational movement of the extractor when activated.

In some embodiments, a delineator extraction system may include a cutting edge positioned at a proximal end of the engager. The cutting edge may function to penetrate the interior surface of the delineator conduit.

In some embodiments, a delineator extraction system may include a grip coupled to a proximal end of the second elongated member. The grip may function to assist a user in grasping and applying force to the second elongated member.

In some embodiments, a delineator extraction system may include a carrying harness configured to assist a user in transporting the delineator extraction system. The carrying harness may be coupled to one or more points on an exterior surface of the outer conduit.

BRIEF DESCRIPTION OF THE DRAWINGS

Advantages of the present invention may become apparent to those skilled in the art with the benefit of the following detailed description of the preferred embodiments and upon reference to the accompanying drawings.

Figure 1:
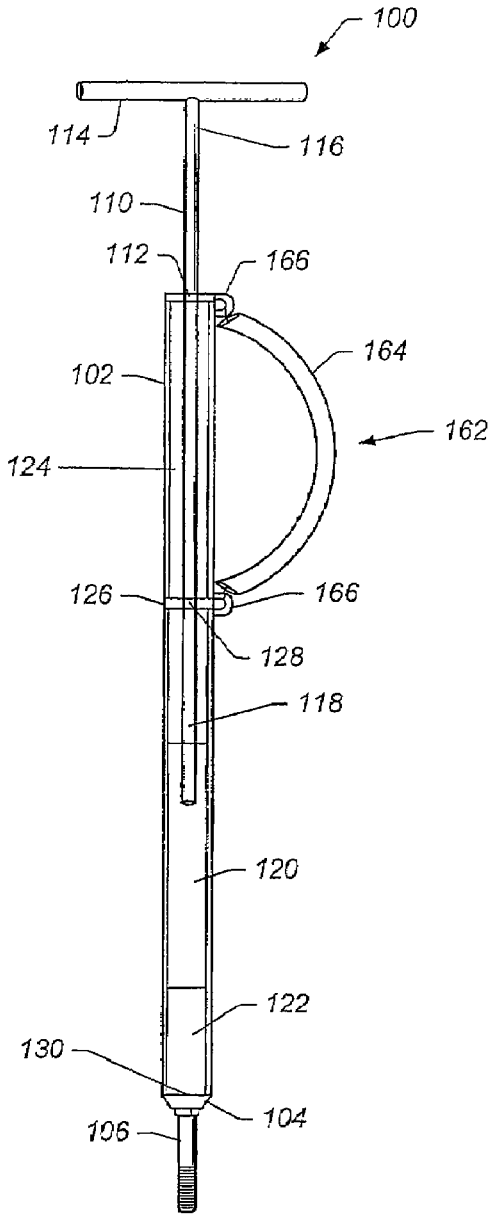
FIG. 1 depicts a representation of a cross-sectional view of an embodiment of a portion of a delineator extractor.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

It is to be understood the present invention is not limited to particular devices or biological systems, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Thus, for example, reference to "a linker" includes one or more linkers.

DEFINITIONS

Unless defined otherwise, all technical and scientific terms used herein have the same meaning as commonly understood by one of ordinary skill in the art.

The term "delineator" as used herein generally refers to a roadway marker, a roadway guide post, and/or a sign post. In some embodiments, a delineator may refer simply to any elongated member positioned in a surface formation.

The term "distal" as used herein generally refers to an end or region of an item situated farthest from a point of attachment or origin, wherein a point of origin refers to an end nearest to an operator or user of the item during use of the item.

The term "proximal" as used herein generally refers to an end or region of an item situated nearest to a point of attachment or origin, wherein a point of origin refers to an end nearest to an operator or user of the item during use of the item.

In some embodiments, a system may function to at least assist a user in removing a previously installed delineator. In some embodiments, a system may function to at least assist a user in positioning and/or installing a delineator. In some embodiments, a system and/or method may include removing what remains of one or more damaged delineators. The system may aid in installing a new delineator system. The apparatus and method increase the efficiency of removing and installing roadside delineators, decreasing the man hours and costs associated with such operations. Although many embodiments and examples described herein are directed towards the use of the described delineator extractor being used in combination with a specific example of a delineator system, this should not be viewed as limiting in how the delineator extractor may be used.

FIG. 1 depicts a representation of a cross-sectional view of an embodiment of a portion of a delineator extractor 100. In some embodiments, a delineator extractor may include an outer conduit 102. An outer conduit may be substantially inflexible. An outer conduit may be formed from a material capable of withstanding forces applied to the outer conduit during use of the delineator extractor. An outer conduit may be formed from steel and/or other similar materials. At least a portion of an opening extending through at least a portion of the outer conduit may have a diameter ranging from 0.5 and 10 inches, 1.0 and 6.0 inches, 1.0 and 3.0 inches, or 1.25 and 2.25 inches. In some embodiments, at least a portion of an opening extending through at least a portion of the outer conduit may have a diameter of about 1.5 inches. An outer conduit may have a length ranging from 2.0 to 6.0 feet, 2.5 to 4.0 feet, or 2.75 to 3.0 feet. In some embodiments, an outer conduit may have a length of about 33 inches.

Figure 2:
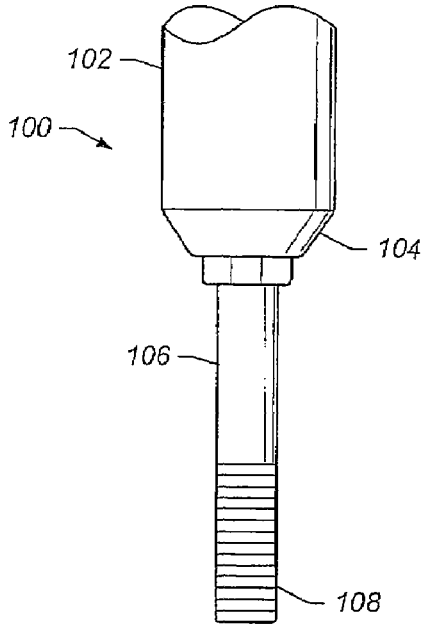
FIG. 2 depicts a representation of an embodiment of a distal portion of a delineator extractor.

FIG. 2 depicts a representation of an embodiment of distal portion 104 of delineator extractor 100. Distal end 104 of outer conduit 102 may be tapered or beveled. The distal end of the outer conduit may have an edge beveled at an angle ranging from 15° to 85°, 30° to 70°, 45° to 65°, or 50° to 60°. In some embodiments, a distal end of the outer conduit may have an edge beveled at an angle of about 55°.

In some embodiments, outer conduit 102 may include elongated member 106 coupled to distal end 104 of the outer conduit. The elongated member may be coupled to the outer conduit along a central axis running through the outer conduit and the elongated member. In some embodiments, an elongated member may be coupled to an outer conduit such that the elongated member is irremovable without damaging the delineator extractor (e.g., the elongated member is welded to the outer conduit). In some embodiments, an elongated member may be coupled to an outer conduit such that the elongated member is removable (e.g., a proximal end of the elongated member is threaded and screwed into a threaded opening positioned at a distal end of the outer conduit). In some embodiments, at least distal end 108 of elongated member 106 may be threaded.

In some embodiments, a delineator extractor may include second elongated member 110. At least a portion of the second elongated member may be positioned in the outer conduit of the delineator extractor. At least the portion of the second elongated member positioned in the outer conduit may have an outer diameter less than an inner diameter of the outer conduit. A second elongated member may be formed from a material capable of withstanding forces applied to the second elongated member during use of the delineator extractor. A second elongated member may be formed from steel and/or other similar materials. A second elongated member may have a diameter ranging from 0.125 to 2.0 inches, 0.25 to 1.0 inches, or 0.4 to 0.5 inches. In some embodiments, a second elongated member may have a diameter of about 0.5 inches.

In some embodiments, a proximal end of the outer conduit may include opening 112 through which second elongated member 110 may be positionable. The opening may be configured to allow axial movement of the second elongated member relative to the outer conduit. The opening may be configured to inhibit side-to-side movement of the second elongated member relative to the outer conduit, ensuring the second elongated member stays centered within the outer conduit. In some embodiments, the opening may have a shape complementary to a cross-section of the second elongated member (e.g., the second elongated member may have a substantially square cross-section and the opening may have a similar square shape large enough to allow the second elongated member to move through freely without allowing the second elongated member to rotate relative to the opening).

In some embodiments, second elongated member 110 may include grip 114 coupled to proximal end 116 of the second elongated member. A grip and a proximal end of the second elongated member may be positioned outside of an outer conduit of a delineator extractor. A grip may function to assist a user to apply more force to the second elongated member in a downward and/or upward direction. In some embodiments, a grip may include an elongated member with sufficient length to allow an operator to comfortably grasp the grip with at least one and/or two hands. In some embodiments, a grip may include an elongated member with sufficient length to allow multiple operators to grasp the grip at the same time such that a greater force may be applied with the delineator extractor during use. A grip may have a diameter ranging from 0.125 to 2.0 inches or 0.25 to 1.0 inches. In some embodiments, a grip may have a diameter of about 0.75 inches.

A grip may be oriented in a perpendicular relationship to the second elongated member (e.g., as depicted in FIG. 1). A grip may be coupled to the second elongated member at a center point along a length of the grip. A grip may be coupled to the second elongated member at an end point along a length of the grip. A grip may be coupled to the second elongated member at any point between a center point and an end point along a length of the grip. A grip may be coupled to the second elongated member at two or more points.

A grip may be formed from a material capable of withstanding forces applied to the grip during use of the delineator extractor. A grip may be formed from steel and/or other similar materials.

In some embodiments, distal end 118 of second elongated member 110 positioned in outer conduit 102 may be coupled to slide hammer 120. The slide hammer may be positioned in the outer conduit. The slide hammer may be positioned in a distal end of the outer conduit. In some embodiments, a slide hammer may be configured to magnify a force applied to a second elongated member during use.

In some embodiments, a slide hammer may be formed from a substantially solid piece of material. A slide hammer may be formed from a material capable of withstanding forces applied to the slide hammer during use of the delineator extractor. A slide hammer may be formed from steel and/or other similar materials.

A slide hammer may have a cross-sectional shape which is complementary to a cross-sectional shape of an opening in an outer conduit of a delineator extractor. Complementary cross-sectional shapes may allow for smooth uninhibited movement of the slide hammer in the outer conduit. A slide hammer may have a diameter which is 0.0625 to 1.0 inches less than a diameter of an opening in an outer conduit of a delineator extractor. A slide hammer may have a diameter ranging from 0.5 to 3.0 inches, 1.0 to 2.0 inches, or 1.25 to 1.5 inches. In some embodiments, a slide hammer may have a diameter of about 1.375 inches. A slide hammer may have a length ranging from 0.25 to 3.0 feet, 0.5 to 2.0 feet, or 0.75 to 1.0 feet. In some embodiments, a slide hammer may have a length of about 10 inches.

In some embodiments, outer conduit 102 may include first portion 122 positioned distally and second portion 124 positioned proximally. The first portion and the second portion may be separated by divider 126 (e.g., a steel plate). The divider may function as a first stop for a slide hammer positioned in the first portion. The divider may function to inhibit movement of the slide hammer beyond the divider. Divider 126 may include opening 128 through which second elongated member 110 may move. The divider opening may be sized to allow movement of the second elongated member through the divider while inhibiting movement of the slide hammer through the divider from the first portion to the second portion of the outer conduit. First portion 122 may include second stop 130 positioned towards or at a distal end of the first portion. The second stop may function to inhibit movement of the slide hammer beyond the second stop. The first and second stops may function to define a first portion of the outer conduit in which the slide hammer is allowed to move during use.

A first portion of an outer conduit may have a length ranging from 1.0 to 4.0 feet, 1.5 to 3.0 feet, or 1.75 to 2.25 feet. In some embodiments, a first portion of an outer conduit may have a length of about 20 inches.

Figure 4A:
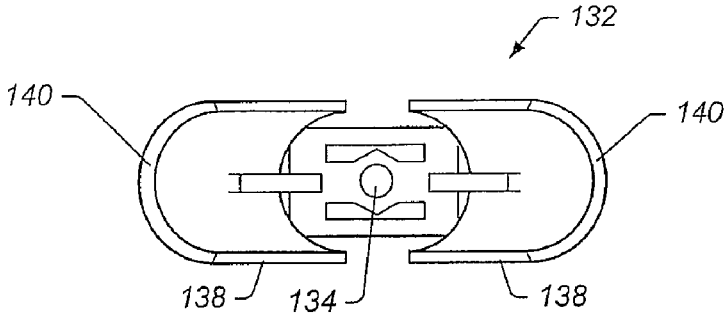
FIGS. 4A-C depict different views of a representation of an embodiment of an extractor uncoupled from a distal portion of a delineator extractor.
Figure 4B:
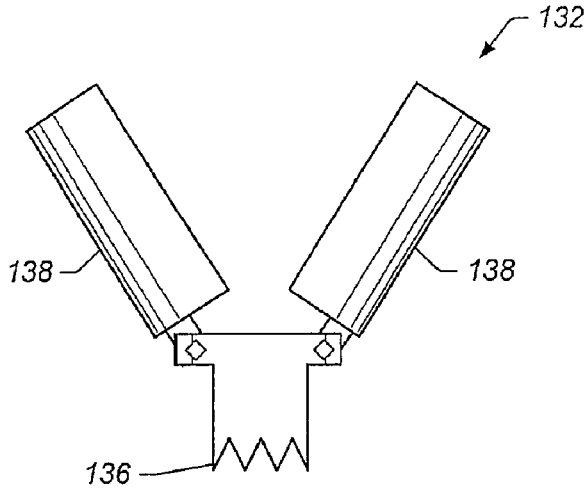
Figure 4C:
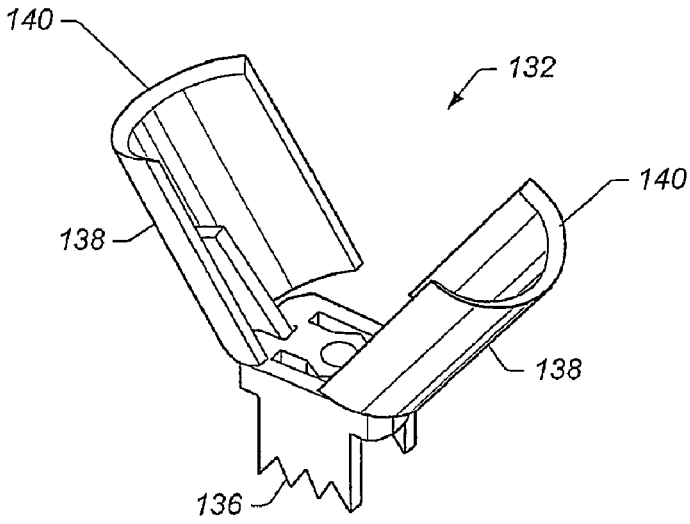

In some embodiments, delineator extractor 100 may include extractor 132. FIGS. 4A-C depict different views of a representation of an embodiment of extractor 132 uncoupled from a distal portion of delineator extractor 100. The extractor may be configured to couple to distal end 108 of elongated member 106. The extractor may include threaded opening 134 (e.g., a nut) which couples to threaded distal end 108 of elongated member 106. Other known methods of coupling may be used to couple the extractor to the elongated member. In some embodiments, an extractor may be coupled to an elongated member such that the extractor is irremovable without damaging the delineator extractor (e.g., the elongated member is welded to the extractor). In some embodiments, an elongated member may be coupled to an extractor such that the elongated member is removable (e.g., a distal end of the elongated member is threaded and screwed into a threaded opening positioned at a proximal end of the extractor).

Extractor 132 may include surface deformations 136 at a distal end of the extractor. The surface deformations may function as teeth configured to "bite" into a surface and inhibit certain types of movement (e.g., rotational movement, side-to-side movement). Surface deformations may include one or more pointed ridges or elongated members. Surface deformations may include one or more cutting edges. The extractor may include any mechanical and/or chemical (e.g., a fast curing adhesive) feature which functions to engage a surface and inhibit certain types of movement of the extractor.

Extractor 132 may include two or more engagers 138. A distal end of the engagers may be coupled to a proximal end of the extractor. The engagers may be coupled to the extractor by a hinged joint allowing a proximal end of the engagers to rotate about the hinge in a direction away from the outer conduit of the delineator extractor during use. The proximal end of engagers 138 may include cutting surface 140. In some embodiments, an extractor may include two engagers. The two engagers may be formed by cutting a section of pipe in half lengthwise.

Figure 3:
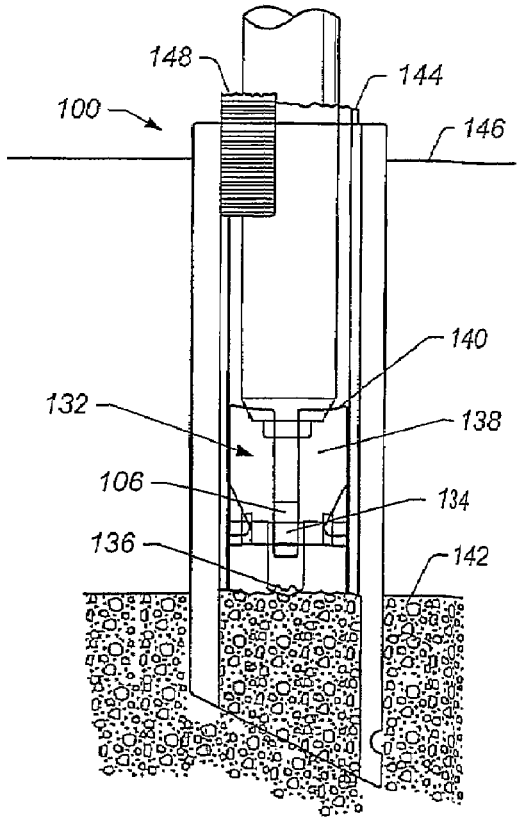
FIG. 3 depicts a representation of an embodiment of a distal portion of a delineator extractor including an extractor coupled to an elongated member, wherein the distal end of the delineator extractor is positioned in a severed delineator.

FIG. 3 depicts a representation of an embodiment of a distal portion of a delineator extractor including an extractor coupled to an elongated member, wherein the distal end of the delineator extractor is positioned in a severed delineator. During use, once the surface deformations of the extractor have been used to engage a surface (e.g., concrete surface 142) at the bottom of an interior of a damaged delineator, a user may then rotate the outer conduit. Rotation of the outer conduit simultaneously rotates the elongated member coupled to the distal end of the outer conduit. Rotation of the elongated member (e.g., in a clockwise direction) forces the outer conduit down towards the extractor as the threaded elongated member conveys through the threaded opening of the extractor.

As the beveled distal end of the outer conduit moves toward the distal end of the extractor, the beveled end forces the proximal ends of the two or more engagers to rotate away from the outer conduit until they engage an interior surface of post 144 (e.g., of a damaged delineator system). A user then operates the slide hammer, using the grip, in an upward motion such that the cutting surfaces of the engagers "bite" into the interior surface of the post of the damaged delineator.

A user may then operate the slide hammer in an upward motion against the first stop, the slide hammer increasing the force applied by the user. As the slide hammer contacts the first stop the cutting surfaces may be forced upward further engaging the interior of the post. Upon adequate engagement of the cutting surfaces into the post the upward force exerted by the user may then transfer to the post. The slide hammer multiplies the upward force exerted by the user extracting the post from the opening in ground 146, in spite of the counteracting force of previously positioned wedge 148.

If a user wishes to disengage the cutting surfaces from the interior surface of the post, the user may, for example, rotate the outer conduit (e.g., in a counter clockwise direction). As the distal end of the outer conduit rotates moving away from the extractor, the beveled end of the outer conduit discontinues applying force to the engagers allowing the engagers to rotate back towards the outer conduit. As the engagers rotate back towards the outer conduit the delineator extractor may be removed from an interior of the post.

Figure 5A:
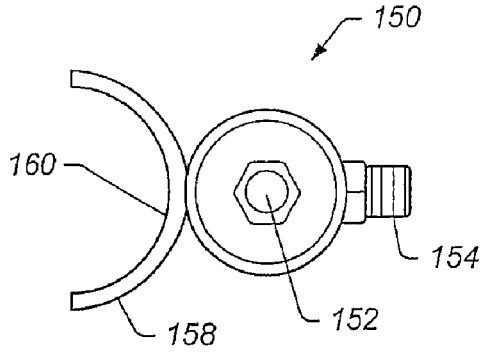
FIGS. 5A-C depict different views of a representation of an embodiment of an installer uncoupled from a distal portion of a delineator extractor.
Figure 5B:
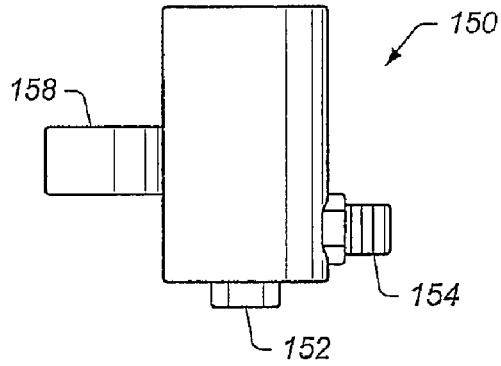
Figure 5C:
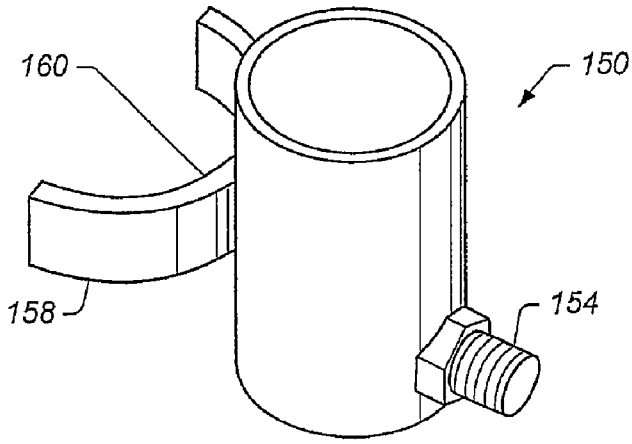

In some embodiments, the delineator extractor may include an installer. FIGS. 5A-C depict different views of a representation of an embodiment of installer 150 uncoupled from a distal portion of delineator extractor 100. The installer may be configured to couple to distal end 108 of elongated member 106. The installer may include threaded opening 152 (e.g., a nut) which couples to threaded distal end 108 of elongated member 106. Installer 150 may include third elongated member 154 coupled to a side of the installer (e.g., a bolt threaded through an opening in the side of the installer). The third elongated member may be coupled to a side of the installer at an angle substantially perpendicular to the installer.

Figure 7:
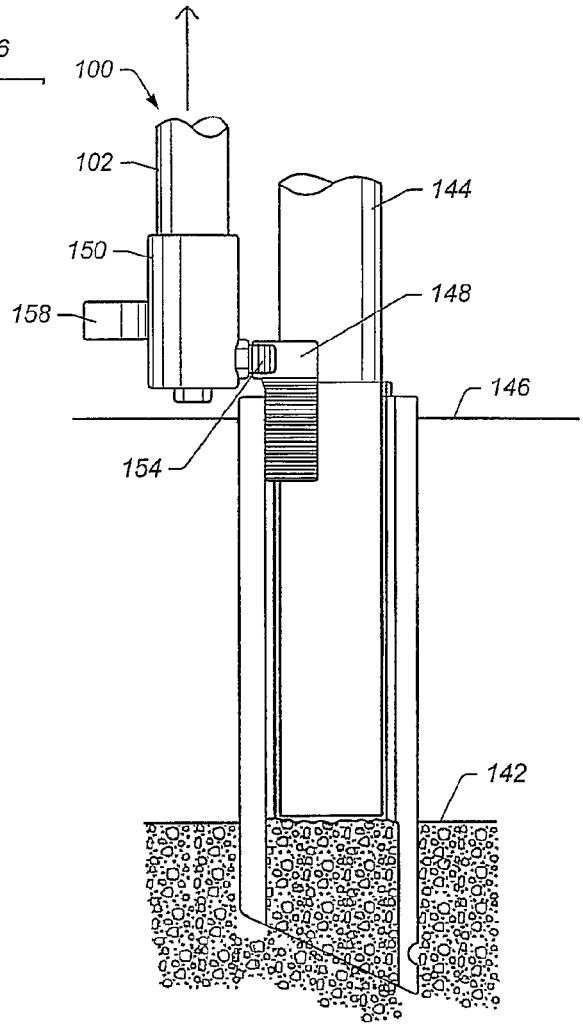
FIG. 7 depicts a representation of an embodiment of a distal portion of a delineator extractor including an installer coupled to an elongated member, wherein a portion of an installer is engaging a wedge during extraction of a delineator system.

The third elongated member may be configured to engage opening 156 in wedge 148 and/or post 144 of delineator system 100. The opening in the wedge may be an existing opening. The opening in the wedge may be formed by the user. The slide hammer may be used to amplify an upward force provided by a user after the third elongated member has engaged the opening in the wedge. The upward force may remove the wedge from an opening in the ground such that the post may be extracted. FIG. 7 depicts a representation of an embodiment of a distal portion of delineator extractor 100 including installer 150 coupled to elongated member 106, wherein a portion of the installer is engaging wedge 148 during extraction of post 144 of a delineator system.

Figure 6:
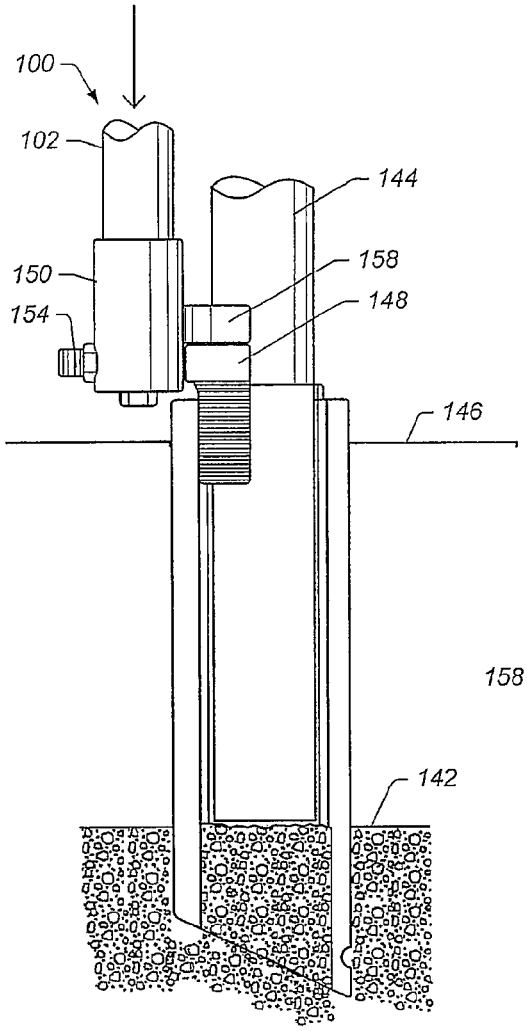
FIG. 6 depicts a representation of an embodiment of a distal portion of a delineator extractor including an installer coupled to an elongated member, wherein a portion of an installer is positioned adjacent a wedge during installation of a delineator system.

Installer 150 may include driver 158 coupled to a side of the installer. Driver 158 may include concave surface 160 facing away from installer 150. The concave surface may be configured to fit around at least a portion of the post of the delineator system such that the installer rests on an upper surface of the wedge (or a lip extending out of the side of a post) positioned adjacent the post. The slide hammer may be used to amplify a downward force provided by a user to install the wedge into an opening such that the post positioned in the opening may be inhibited from moving. FIG. 6 depicts a representation of an embodiment of a distal portion of a delineator extractor including an installer coupled to an elongated member, wherein a portion of an installer is positioned adjacent a wedge during installation of a delineator system.

In some embodiments, a delineator extractor may include carrying harness 162 (e.g., as depicted in FIG. 1). A carrying harness may include, for example, shoulder strap 164. A carrying harness may be coupled to the outer conduit of a delineator extractor at one or more points 166. A carrying harness may be configured to be removable by a user when the user desires.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A delineator extraction system, comprising:

an outer conduit comprising a first distally positioned portion and a second proximally positioned portion, wherein the first portion and the second portion are separated by a first stop, wherein the first portion comprises a second stop positioned proximate a distal end of the outer conduit, and wherein the outer conduit is configured to be positioned at least partially in a delineator conduit;

a first elongated member comprising a proximal end coupled proximate the distal end of the outer conduit, wherein a distal end of the first elongated member is at least partially threaded;

a slide hammer positioned proximate the first portion of the outer conduit, wherein the slide hammer is moveable in the first portion of the outer conduit between the first and second stops, wherein the slide hammer is configured to convey a force applied by a user;

a second elongated member, wherein a distal end of the second elongated member extends through a first opening in the first stop, wherein the distal end is coupled to the slide hammer, and wherein a proximal end of the second elongated member extends through a second opening in a proximal end of the outer conduit; and an extractor couplable to the threaded distal end of the first elongated member, wherein the extractor comprises:

a third opening, wherein the opening is at least partially threaded such that the opening can be coupled proximate to the distal end of the first elongated member and positionable along the threaded portion of the first elongated member; and at least one engager, wherein a distal end of at least one of the engagers is coupled to the extractor such that the proximal end of at least one of the engagers is configured to rotate away from the outer conduit as the distal end of the outer conduit moves toward the extractor such that the proximal end of the engager engages an interior surface of the delineator conduit;

wherein the delineator extraction system is configured to extract a delineator installed in a surface formation.

2. The delineator extraction system of claim 1, further comprising surface deformations positioned proximate a distal end of the extractor.

3. The delineator extraction system of claim 1, further comprising surface deformations positioned proximate a distal end of the extractor, wherein the surface deformations are configured to engage a surface.

4. The delineator extraction system of claim 1, further comprising surface deformations positioned proximate a distal end of the extractor, wherein the surface deformations are configured to inhibit rotational movement of the extractor during use.

5. The delineator extraction system of claim 1, wherein at least one of the engagers comprises a cutting edge positioned proximate a proximal end of the engager.

6. The delineator extraction system of claim 1, wherein at least one of the engagers comprises a cutting edge positioned proximate a proximal end of the engager, wherein the cutting edge is configured to penetrate at least a portion of the interior surface of the delineator conduit.

7. The delineator extraction system of claim 1, further comprising a grip coupled proximate a proximal end of the second elongated member.

8. The delineator extraction system of claim 1, further comprising a grip coupled proximate a proximal end of the second elongated member, wherein the grip is configured to assist a user in grasping and applying force to the second elongated member.

9. The delineator extraction system of claim 1, further comprising a carrying harness configured to assist a user in transporting the delineator extraction system.

10. The delineator extraction system of claim 1, further comprising a carrying harness, wherein the carrying harness is coupled to one or more points on an exterior surface of the outer conduit.

11. The delineator extraction system of claim 1, wherein the slide hammer is configured to amplify a force applied by a user.

12. The delineator extraction system of claim 1, further comprising an installer couplable to the threaded distal end of the first elongated member, wherein the installer comprises:

a third elongated member coupled to an exterior surface of the installer, wherein the third elongated member is configured to engage an opening in the delineator facilitating removal of at least a portion of the delineator.

13. The delineator extraction system of claim 1, further comprising an installer couplable to the threaded distal end of the first elongated member, wherein the installer comprises:

a driver coupled to an exterior surface of the installer, wherein the driver comprises a concave surface configured to engage at least a portion of the delineator facilitating installation of the delineator.

* * * * *